US009124980B2

(12) United States Patent
Doy

(10) Patent No.: US 9,124,980 B2
(45) Date of Patent: Sep. 1, 2015

(54) SYSTEM AND METHOD FOR OPTIMIZED PLAYBACK OF AUDIO SIGNALS THROUGH HEADPHONES

(75) Inventor: Anthony S. Doy, Los Gatos, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 418 days.

(21) Appl. No.: 13/544,221

(22) Filed: Jul. 9, 2012

(65) Prior Publication Data

US 2014/0010381 A1 Jan. 9, 2014

(51) Int. Cl.
*H04R 1/10* (2006.01)
*H04R 29/00* (2006.01)

(52) U.S. Cl.
CPC ..... *H04R 29/00* (2013.01); *H04R 1/1041* (2013.01)

(58) Field of Classification Search
CPC ..... H04R 29/001; H04R 5/033
USPC ..... 381/59, 74
See application file for complete search history.

(56) References Cited

U.S. PATENT DOCUMENTS

| | | | | |
|---|---|---|---|---|
| 7,579,832 | B1 | 8/2009 | Blackburn et al. | |
| 2013/0216052 | A1 * | 8/2013 | Bruss et al. | 381/59 |
| 2014/0003616 | A1 * | 1/2014 | Johnson et al. | 381/74 |

* cited by examiner

*Primary Examiner* — Simon King
(74) *Attorney, Agent, or Firm* — TIPS Group

(57) ABSTRACT

The application discloses a system and method for playback of audio signals though a large variety of headphone devices. To optimize playback, the specific headphone device is identified so the proper amplifier gain and equalization settings can be applied. Such identification is determined by measuring the headphone impedance as a function of frequency, and comparing the impedance data with data of know devices in a database. Once a match is found, the appropriate audio gain and equalization settings can be applied.

16 Claims, 4 Drawing Sheets

SYSTEM AND METHOD FOR OPTIMIZED PLAYBACK OF AUDIO SIGNALS THROUGH HEADPHONES

BACKGROUND

Users of mobile electronic devices such as cell phones, MP3 players, and lap top computers often utilize a number of different headphone type devices for listening to the audio output of their electronic devices. For example, a user may have a headset/microphone combination for use with voice communication or conferencing in the workplace. The same user may have stereo headphones for music listening, and perhaps "ear bud" devices for use while exercising.

The use of all these different headphone type listening devices with a single portable electronic device can have compatibility issues. Firstly, the sensitivity varies considerably from manufacturer to manufacturer and product type to product type. The sensitivity is the measure of the amount of voltage (or power) needed to produce a given sound pressure level (SPL) in the user's ear. Swapping a high sensitivity headphone device subsequent to the use of a low sensitivity device may cause pain and ear damage due to the high SPL produced at the volume setting previously used with the low sensitivity device. Secondly, the impedance of various headphone listening devices can vary almost three orders of magnitude, from about 10 ohms to nearly 1000 ohms. This impedance variation can require different amplifier gain settings for optimum operation. Thirdly, headphone devices may require customized frequency equalization (EQ) for the best sound performance. Equalization is the process in which the frequency response of the headphone device is altered to better suit the listening requirements of the user. Preset tonal settings (e.g. "rock", "jazz", etc.) are often used.

Attempts have been made to have an electronic device try to determine the type of headphone that is being used. These attempts often involve a making a simple DC resistance measurement of the headphone. Unfortunately, this type of measurement is inadequate to distinguish accurately between the large number of headphone devices and their sensitivity or equalization requirements.

These and other limitations of the prior art will become apparent to those of skill in the art upon a reading of the following descriptions and a study of the several figures of the drawing.

SUMMARY

In an embodiment, set forth by example and not limitation, a method for playback of audio signals in a headphone device includes sending an audio test signal to the headphone device, the audio test signal containing a plurality of signals having energy at frequencies between 20 Hz and 20 KHz; measuring an electrical current and voltage delivered to the headphone device during playback of the audio test signal; computing the impedance of the headphone device from measured voltage and measured electrical current; and comparing the impedance of the headphone device with impedance data from a plurality of previously measured headphone devices.

In another embodiment, set forth by example and not limitation, a method for playback of audio signals in a headphone device includes providing an electronic playback device; detecting a connection between the electronic playback device and the headphone device; sending an audio test signal generated in the electronic playback device to the headphone device, the audio test signal containing a plurality of signals having energy at frequencies between 20 Hz and 20 KHz; having the electronic playback device measure the electrical current and voltage delivered to the headphone device during playback of the audio test signal; having the electronic playback device compute an impedance of the headphone device from measured voltage electrical current; and having the electronic playback device compare the impedance of the headphone device with impedance data from a plurality of previously measured headphone devices.

An advantage of example embodiments is that a large number of headphone products having varying sensitivities, impedance characteristics, and equalization requirements can be used with an electronic device.

Another advantage of example embodiments is that a system and a method for identifying a headphone product as it is plugged into a portable audio device is provided. For example, amplifier gain, voltage output levels, and equalization requirements can be automatically determined in example embodiments.

In another example embodiment, a system and method can identify a specific type of headphone device by measuring the device's impedance as a function of frequency, providing an audio "fingerprint" that can be compared to a database of known commercial products. Such a database can be used to provide sensitivity, amplifier gain, and equalization requirements for the unknown device once a match is confirmed.

These and other embodiments, features and advantages will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF EXAMPLE EMBODIMENTS

Figure 1:
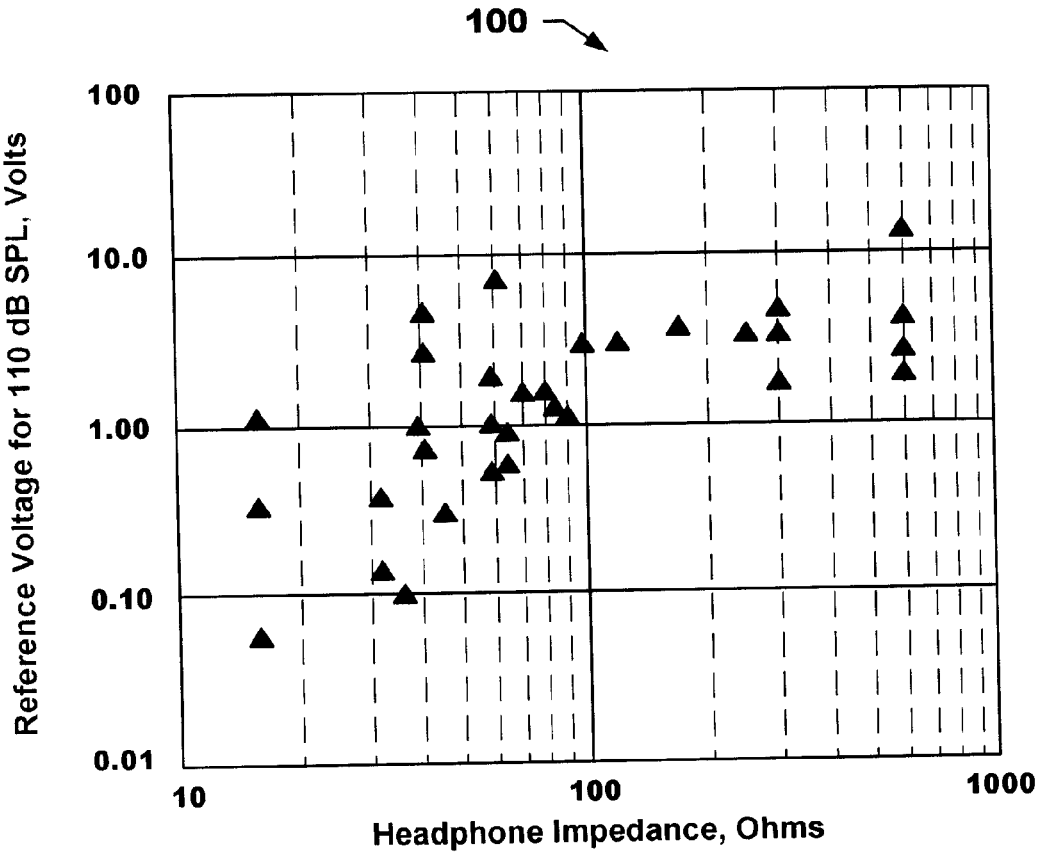
FIG. 1 is a graph, set forth by way of example and not limitation, of voltages providing normalized 110 dB SPL acoustic output as a function of headphone impedance for a variety of commercial headphone products.

FIG. 1 is a graph 100, set forth by way of example and not limitation, of voltages providing normalized 110 dB SPL acoustic output as a function of headphone impedance for a variety of commercial headphone products. In this example, the voltage plotted in FIG. 1 is the voltage which produces a sound pressure level of 110 dB (decibels) in the user's ear, and is therefore representative of the sensitivity of various headphone devices. The diamonds plotted in the graph represent individual products. Data was taken at a fixed frequency of 1000 Hz. As can be noted from the data of FIG. 1, impedance varies over a very wide range, from about 16 ohms to about 600 ohms, with drive voltage (for this 110 dB SPL example) varying from below 0.1 volt to over 10 volts. As also can be noted, sensitivity varies considerably even among products with the same nominal impedance. The three products plotted at 16 ohms, for example, have a sensitivity that varies from about 0.08 volts to over 1 volt to obtain the same acoustic output. This plot clearly illustrates that the proper identification of headphone devices requires more than the measurement of the impedance at DC or a single frequency. The plot further indicates that operation of an audio device with headphones having such a wide range of sensitivities and impedances would benefit from proper identification of the headphone, coupled with adjustment of amplifier gain and output levels to prevent damage to the headphone devices or the user's ears. Furthermore, any system generated power nodes to supply the headphone amplifier can be optimized for higher efficiency.

Figure 2:
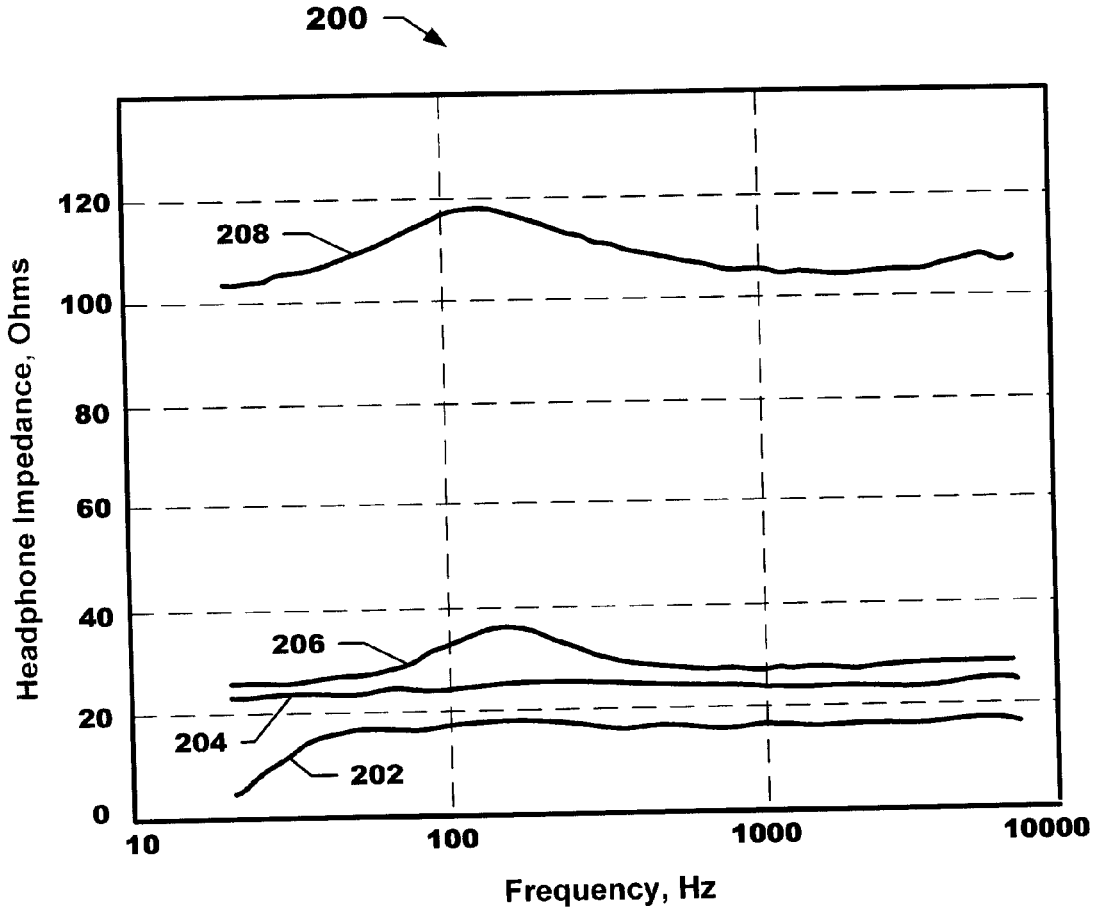
FIG. 2 is a graph of headphone impedance as a function of audio frequency for certain example headphone products.

FIG. 2 is a graph 200 of headphone impedance as a function of audio frequency for four example headphone products. A first product is illustrated by the impedance versus frequency plot 202. A second product is illustrated by plot 204. Third and fourth products are illustrated by plots 206 and 208. The products illustrated in FIG. 2 not only show the large variation in impedance levels between plots 202 and 208, but that each product has a unique shape to its frequency response plot. This unique shape can be utilized to identify specific products and their audio characteristics.

Figure 3:
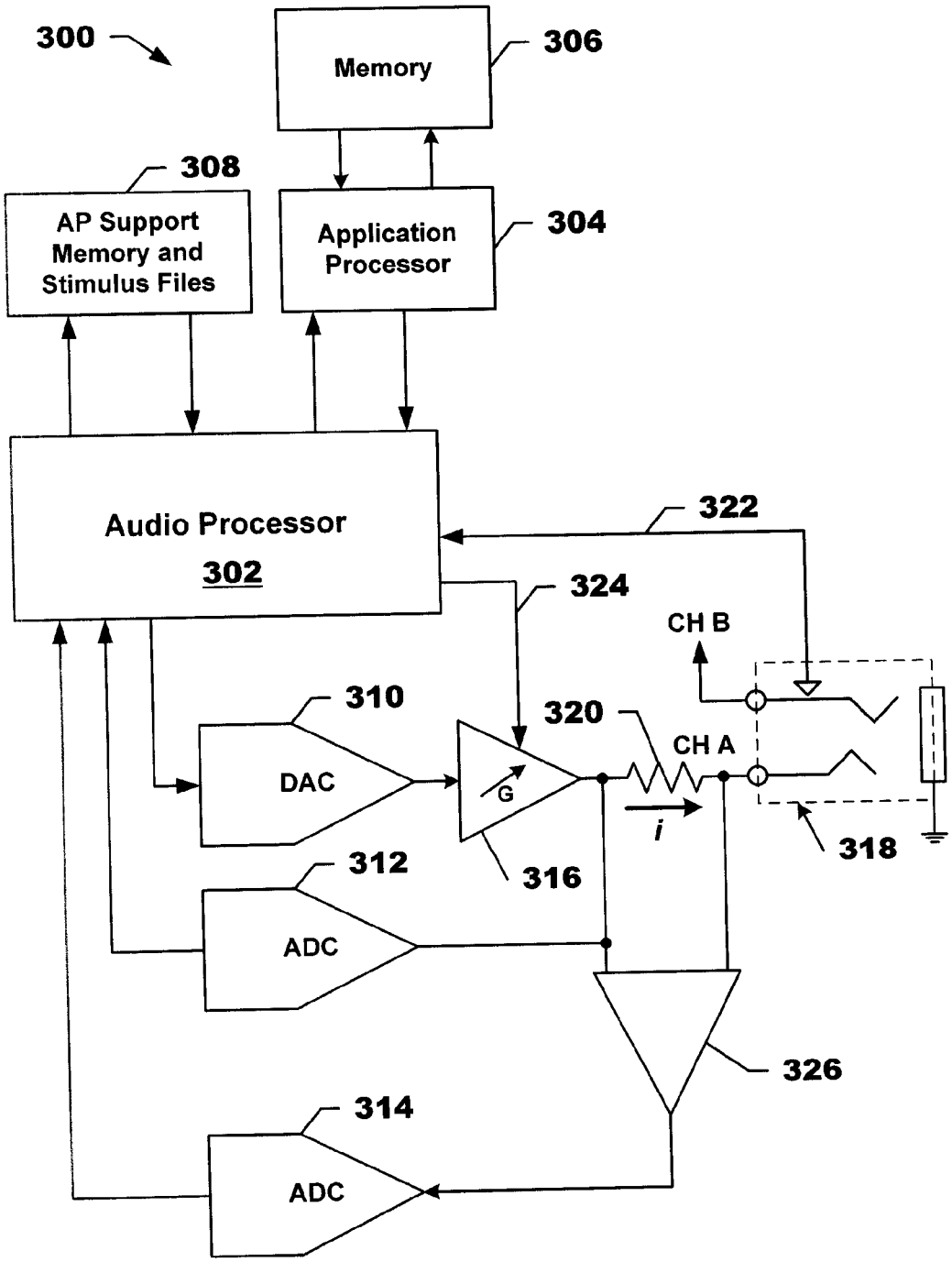
FIG. 3 is a block diagram of an example processing system for delivering audio to headphones.

FIG. 3 is a block diagram 300 of an example processing system for delivering audio to headphones. The system contains Audio Processor 302, the central processing unit enabled to carry out the identification of the headphone devices as well as deliver the properly processed audio signals to them. Audio processor 302 is connected via digital busses to the Application Processor 304 and system memory 306. Application processor 304 may be the main processor in a mobile device such as a smart phone or the main CPU of a laptop computer, by way of non-limiting examples. Processor 304 is responsible for delivering digital audio files (such as MP3 files, for example) to the Audio processor 302 for playback in the headphone device. Audio processor 302 may also access system memory 306 via processor 304 if required. Audio processor 302 is connected via digital busses to memory device 308 which provides storage for stimulus files and audio processor support memory. Storage of the characteristic headphone impedance versus frequency data, the associated sensitivity data, and EQ requirements may be stored in support memory 308. Alternatively, this data may also be stored in non-volatile system memory 306.

Audio processor 302 is connected via digital busses to digital to analog converter (DAC) 310, analog to digital converter (ADC) 312, and analog to digital converter (ADC) 314. The output of DAC 310 is fed to variable gain amplifier 316. The gain of amplifier 316 is controlled by the Audio processor 302 via signal line 324. In one example, current sense resistor 320 is placed in series with the headphone impedance to facilitate load current measurement via differential amplifier 326. As will be appreciated by those skilled in the art, current sensing to the headphone device may be accomplished by other means as well. Analog current measurement data from differential amplifier 326 is digitized by ADC 314 and delivered to the Audio processor 302. Voltage data is digitized by ADC 312 and delivered to the Audio processor 302. The headphone device is plugged into jack 318. A contact senses the introduction of the headphone plug into jack 318, and notifies the Audio processor 302 via signal line 322. The audio signal path illustrated in FIG. 3 represents connection of a single channel (CH A comprising DAC 310, ADC 312, 314, amplifiers 316, 326) to headphone jack 318. For stereo audio an additional identical channel is required (CH B), which is not shown for clarity. Audio music/voice signals are delivered to headphone jack 318 via DAC 310 and amplifier 316.

In order to determine the impedance of a headphone connected to jack 318, Audio processor 302 sends a stimulus signal via DAC 310 and amplifier 316 to the connected headphone. Since both the load current and output voltage are monitored as a function of frequency, the impedance as a function of frequency can be computed. The impedance as a function of frequency data, or "fingerprint," can then be used to compare the connected headphone with a database of known products, or stored as new data. Audio processor 302 may also perform other audio processing tasks such as equalization, filtering, compression, etc. during, for example, subsequent playback of audio, as will be appreciated by those skilled in the art.

Figure 4:
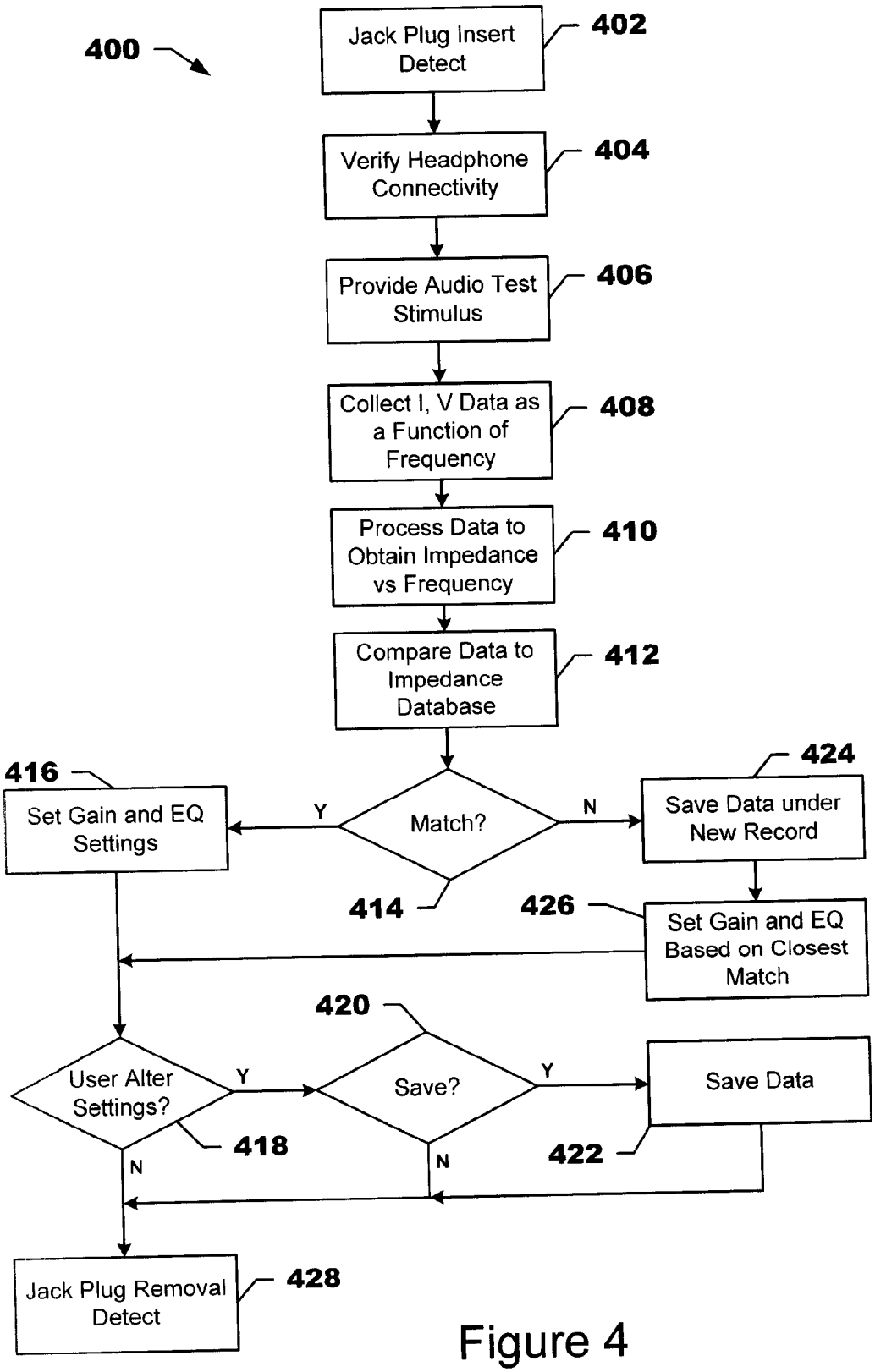
FIG. 4 is a flow diagram of an example process for delivering audio to headphones.

FIG. 4 is a block diagram 400 of an example process for delivering audio test signals to headphones. The process begins at step 402, wherein insertion Utile headphone plug into jack 318 is detected. In step 404, the connectivity of the headphone is verified. In step 406, an audio stimulus signal (also referred to as an "audio test signal", a "stimulus signal", etc.) is generated. Typically, this is an AC sine wave sweep over a range of audio frequencies. In one example, the frequency may be swept between at least 20 Hz to at most 20 KHz to provide a plurality of signals having energy in that frequency range. Alternatively, a known broadband pink noise or white noise signal may also be used. In step 408, the current and voltage delivered to the headphone during the audio stimulus is measured. In step 410, the current and voltage data acquired in step 408 is processed to obtain the impedance versus frequency of the headphone device. In step 412, the impedance versus frequency data is compared to data stored in memory. In step 414, if a match is obtained, the process is directed to step 416. If no match is obtained, the process is directed to step 424. In step 416, amplifier 316 gain and EQ settings are determined from the matched data. In step 418, if the user has altered the gain or EQ settings, the changes can be saved by directing the process to step 420. If no alterations are detected, the process is directed from step 418 to step 428. If the data is to be saved, the process is directed from step 420 to 422. After saving the data, the process is directed from step 422 to step 428.

Returning to step 424, the data is saved under a new record. In step 426, gain and EQ settings may be determined by the closest match to a product in the database. Alternatively, gain and EQ settings may be determined by interpolation between two or more closely matched products in the database. Following step 426, the process is returned to step 418. In step 428, the process is terminated when removal of the headphone plug from jack 318 is detected.

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. For example, process steps can be aggregated, separated, and reordered in various example embodiments. It is therefore intended that the claims be interpreted in accordance with the true spirit and scope of the invention without limitation or estoppel.

What is claimed is:

1. A method for playback of audio signals in a headphone device comprising:

detecting a connection between a headphone device and an electronic playback device;

sending an audio test signal to said headphone device, said audio test signal comprising a plurality of signals having energy at frequencies between 20 Hz and 20 KHz;

measuring an electrical current and voltage delivered to said headphone device during playback of said audio test signal;

computing an impedance of said headphone device from said measured voltage and said measured electrical current;

comparing said impedance of said headphone device with impedance data from a plurality of previously measured headphone devices; and setting gain and equalization settings of said electronic playback device based on the comparison of said impedance of said headphone device with the impedance data of said plurality of said previously measured headphone devices.

2. The method as recited in claim 1 wherein detecting said connection between said headphone device and said electronic playback device comprises detecting an insertion of a plug attached to said headphone device within a jack mounted in said playback device.

3. A method for playback of audio signals in a headphone device comprising:

sending an audio test signal to said headphone device, said audio test signal comprising a plurality of signals having energy at frequencies between 20 Hz and 20 KHz;

measuring an electrical current and voltage delivered to said headphone device during playback of said audio test signal;

computing an impedance of said headphone device from said measured voltage and said measured electrical current; and comparing said impedance of said headphone device with impedance data from a plurality of previously measured headphone devices;

wherein said audio test signal comprises a sine wave signal swept from a frequency of at least 20 Hz to a frequency of no more than 20 KHz.

4. The method as recited in claim 3 wherein said impedance of said headphone is computed as a function of frequency from at least 20 Hz to no more than 20 KHz.

5. The method as recited in claim 4 wherein said impedance data from said plurality of said previously measured headphone devices is provided as a function of frequency from at least 20 Hz to no more than 20 KHz.

6. A method for playback of audio signals in a headphone device comprising:

sending an audio test signal to said headphone device, said audio test signal comprising a plurality of signals having energy at frequencies between 20 Hz and 20 KHz;

measuring an electrical current and voltage delivered to said headphone device during playback of said audio test signal;

computing an impedance of said headphone device from said measured voltage and said measured electrical current; and comparing said impedance of said headphone device with impedance data from a plurality of previously measured headphone devices;

wherein said voltage delivered to said headphone device during playback of said audio test signal is measured by a second analog to digital converter, a digital output of said second analog to digital converter being delivered to said audio processor; and wherein said audio test signal is generated in an audio processor as a digital signal, said digital signal being sent to a digital to analog converter for conversion to an analog audio test signal, said analog audio test signal being amplified by a variable gain amplifier prior to being sent said headphone device.

7. The method as recited in claim 6 wherein said electrical current being delivered to said headphone device during playback of said audio test signal flows through a current sensing resistor in series with said impedance of said headphone device.

8. The method as recited in claim 7, wherein said electrical current is determined by a differential amplifier measuring a voltage drop across said sensing resistor, an output of said differential amplifier being digitized by a first analog to digital converter, a digital output of said first analog to digital converter being delivered to said audio processor.

9. A method for playback of audio signals in a headphone device comprising:

providing an electronic playback device;

detecting a connection between said electronic playback device and said headphone device;

sending an audio test signal generated in said electronic playback device to said headphone device, said audio test signal comprising a plurality of signals having energy at frequencies between 20 Hz and 20 KHz;

having said electronic playback device measure an electrical current and voltage delivered to said headphone device during playback of said audio test signal;

having said electronic playback device compute an impedance of said headphone device from said measured voltage and said measured electrical current; and having said electronic playback device compare said impedance of said headphone device with impedance data from a plurality of previously measured headphone devices;

wherein said audio test signal comprises a sine wave signal swept from a frequency of at least 20 Hz to a frequency of no more than 20 KHz.

10. The method as recited in claim 9, wherein detecting said connection between said headphone device and said electronic playback device comprises detecting an insertion of a plug attached to said headphone device within a jack mounted in said playback device.

11. The method as recited in claim 9, wherein said impedance of said headphone is computed as a function of frequency from at least 20 Hz to no more than 20 KHz.

12. The method as recited in claim 11, wherein said impedance data from said plurality of said previously measured headphone devices is provided as a function of frequency from at least 20 Hz to no more than 20 KHz.

13. A method for playback of audio signals in a headphone device comprising providing an electronic playback device;

detecting a connection between said electronic playback device and said headphone device;

sending an audio test signal generated in said electronic playback device to said headphone device, said audio test signal comprising a plurality of signals having energy at frequencies between 20 Hz and 20 KHz;

having said electronic playback device measure an electrical current and voltage delivered to said headphone device during playback of said audio test signal;

having said electronic playback device compute an impedance of said headphone device from said measured voltage and said measured electrical current;

having said electronic playback device compare said impedance of said headphone device with impedance data from a plurality of previously measured headphone devices; and saving computed impedance data of said headphone device subsequent to comparison of said impedance of said headphone device with said impedance data from a plurality of previously measured headphone devices.

14. A method for playback of audio signals in a headphone device comprising providing an electronic playback device;

detecting a connection between said electronic playback device and said headphone device;

sending an audio test signal generated in said electronic playback device to said headphone device, said audio test signal comprising a plurality of signals having energy at frequencies between 20 Hz and 20 KHz;

having said electronic playback device measure an electrical current and voltage delivered to said headphone device during playback of said audio test signal;

having said electronic playback device compute an impedance of said headphone device from said measured voltage and said measured electrical current;

having said electronic playback device compare said impedance of said headphone device with impedance data from a plurality of previously measured headphone devices; and setting gain and equalizer settings of said electronic playback device based on the comparison of said impedance of said headphone device with the impedance data of said plurality, of said previously measured headphone devices.

15. The method as recited in claim 14, wherein said gain and equalizer settings of said electronic playback device are determined by a closest match of said impedance of said headphone device with impedance data of a known headphone device.

16. The method as recited in claim 14, wherein said gain and equalizer settings of said electronic playback device are determined by comparison of said impedance of said headphone device with impedance data of one or more known headphone devices.

* * * * *